US007165705B2

(12) United States Patent
Haro

(10) Patent No.: US 7,165,705 B2
(45) Date of Patent: Jan. 23, 2007

(54) BACK PACK

(76) Inventor: Robert B. Haro, 1324 Belleview Ave., Cardiff, CA (US) 92007

( * ) Notice: Subject to any disclaimer, the term of this patent is extended or adjusted under 35 U.S.C. 154(b) by 486 days.

(21) Appl. No.: 10/668,923

(22) Filed: Sep. 23, 2003

(65) Prior Publication Data

US 2005/0061844 A1 Mar. 24, 2005

(51) Int. Cl.
*A45F 3/04* (2006.01)

(52) U.S. Cl. ..... 224/629; 224/627; 224/628; 224/645; 224/654; 224/657

(58) Field of Classification Search ..... 224/241, 224/627, 628, 629, 637, 638, 639, 645, 650, 224/651, 652, 653, 654, 657, 930
See application file for complete search history.

(56) References Cited

U.S. PATENT DOCUMENTS 3,017,567 A * 1/1962 Barringer ..... 224/930
3,233,803 A 2/1966 Gray
D236,388 S 8/1975 Walters
3,902,640 A * 9/1975 Geiben ..... 224/629
3,995,802 A * 12/1976 Johnston ..... 224/629
D243,889 S 3/1977 Walters
4,085,873 A 4/1978 Schweitzer
4,609,084 A * 9/1986 Thomas ..... 224/259
4,925,064 A 5/1990 Comora
5,370,287 A 12/1994 Cormier
5,447,261 A * 9/1995 Mitomi et al. ..... 224/629
D375,622 S 11/1996 Croft
5,573,155 A 11/1996 Sadler
5,632,429 A 5/1997 Cantwell
D387,198 S 12/1997 Lehmann et al.
5,911,348 A 6/1999 Shook
D418,972 S 1/2000 Gold
D421,523 S 3/2000 Freyer
D426,951 S 6/2000 Rohrbach et al.
6,095,389 A 8/2000 Fenton et al.
6,176,408 B1 * 1/2001 Miner et al. ..... 224/653
6,179,186 B1 1/2001 Blanking
D446,008 S 8/2001 Schulze
6,286,674 B1 * 9/2001 Richard et al. ..... 224/919
6,325,262 B1 * 12/2001 Thompson ..... 224/628

(Continued)

OTHER PUBLICATIONS

Futori Design, www.futori.co.uk/parasit1.html, May 3, 2001.

(Continued)

*Primary Examiner*—Gary E. Elkins
(74) *Attorney, Agent, or Firm*—Gordon & Rees LLP

(57) ABSTRACT

A back pack has a base member for facing the back of a wearer with a raised peripheral rim, and an outer shell of rigid material for facing away from the back of the wearer, the base member and outer shell together defining an enclosure for containing items to be carried. The outer shell has an integral peripheral rim bent towards the base member, and a zipper fastener is secured directly between the peripheral rims of the base member and outer shell and extends around at least a major portion of the rims to provide a secure closure as well as easy access to the enclosure.

16 Claims, 4 Drawing Sheets

U.S. PATENT DOCUMENTS

| | | | | |
|---|---|---|---|---|
| D456,601 | S | 5/2002 | Kegels | |
| D461,048 | S | 8/2002 | Blanking | |
| 6,474,524 | B1 * | 11/2002 | Ivarson et al. | 224/653 |
| D471,353 | S | 3/2003 | Ho | |
| 6,536,637 | B1 | 3/2003 | McLaughlin | |
| 6,685,072 | B2 * | 2/2004 | Ho | 224/629 |
| 2002/0113102 | A1 | 8/2002 | Klamm | |
| 2002/0113103 | A1 | 8/2002 | O'Hare | |

OTHER PUBLICATIONS

Photographs of motorcycle racer's with racing suits, mcnews.com.au, Aug. 2002.

* cited by examiner

BACK PACK

BACKGROUND OF THE INVENTION

The present invention relates generally to back packs, and is particularly concerned with a back pack having a hard or rigid outer shell.

Traditional back packs are made of fabric or soft material such as canvas, nylon, leather and the like. Disadvantages of such back packs are that they are not particularly durable, do not protect fragile items against impacts or dropping, and can be uncomfortable to wear when the edges of hard items such as books are pressed against the rear wall of the back pack, and thus against the wearer's back. In order to avoid or reduce these problems, some back packs have been made partially or completely of hard or rigid material. One such hard shell back pack is described in U.S. Pat. No. 5,911,348 of Shook. This back pack has a hollow base shell of rigid material with an upper or outer opening closed by a rigid lid which is hinged at one end to the top of the base shell, and releasably secured in a closed position by a latch. It is necessary in this case to place raised cushion pads on the lower wall of the base shell, so that it does not rest directly against the user's back, and the hard material of the shell does not cause discomfort. The mechanical hinge and latch closure of this back pack is not ideal.

U.S. Pat. No. 6,179,186 of Blanking describes a back pack which has a flexible inner wall facing the back of the user, and a dimensionally stable outer shell to protect fragile objects in the back pack from impact. In this back pack, the rigid plastic shell is riveted to the fabric inner wall, and is hinged to pivot into a partially open position with the opening at the top of the back pack. This can make it difficult to retrieve items from the bottom of the back pack, since the pack cannot be fully opened due to the rivets.

SUMMARY OF THE INVENTION

It is an object of the present invention to provide a new and improved back pack.

According to one aspect of the present invention, a back pack is provided which comprises a base member for facing the back of a wearer having a raised peripheral rim, at least the peripheral rim being of flexible material, an outer shell of rigid material for facing away from the back of the wearer, the base member and outer shell together defining an enclosure for containing items to be carried, the outer shell having an outer face and an integral peripheral rim bent towards the base member, and a zipper fastener secured between the peripheral rims of the base member and outer shell and extending around at least a major portion of the rims to provide access to the enclosure.

In an exemplary embodiment of the invention, the peripheral rims have a lower end, opposite sides, and an upper end, and the zipper fastener extends around the sides and upper end of the peripheral rims, with the lower ends permanently secured together by a single connecting piece of fabric or other flexible fabric acting as a hinge. This permits the back pack to be completely opened, for easy access to its interior to allow items to be removed or inserted. A releasable retaining flap assembly may be provided between the base member and outer shell to hold the back pack in a partially open position, and this may be released if the user wants to move the base member and outer shell farther away from one another into a completely open position.

The zipper fastener is sewn directly onto the rigid rim of the outer shell, and onto the fabric or flexible rim of the base member, allowing the back pack to open and close fully without the use of a mechanical hinge or rubber seal. The flexible connecting piece of fabric or the like permits the "hinge" action of rotating the upper ends of the base member and shell away from one another until they lie substantially flat and completely open. The outer shell is of rigid material which is weather proof and impact proof, and will protect the contents of the back pack against impact or damage.

Shoulder straps are secured to the base member for supporting the back pack on the wearer's shoulders, and an upper carrying handle may also be provided for use if the user would rather carry the back pack by hand. The base member may comprise inner and outer flexible layers with an insert panel of rigid material between the layers, so that the back pack wearer is more insulated from hard items in the enclosure. The insert panel is sufficiently rigid such that the base member will be self-supporting and hold its shape when the back pack is opened. The panel may have ribs for added rigidity. A layer of foam or other cushioning material may be placed between the insert panel and outer resilient layer of the base member.

The shape of the base member and outer shell will be ergonomically designed to follow the general curvature of the wearer's back, and the outer shell may have a raised aerodynamically shaped hump adjacent the upper end of the back pack if it is intended to be used by bicycle or motor bike riders, to provide a smooth aerodynamic curve from the wearer's helmet to their back when they are leaning forward over the bike's handle bars. The outer shell is of any suitable durable, shatter-proof and weather resistant, hard or rigid material, such as ABS or polycarbonate plastic. A fabric cover layer may be secured or laminated over the outer shell if desired, so that it conforms in appearance to the outer fabric layer of the base member. However, the outer shell may alternatively be provided in various colors and finishes, such as metallic finishes, or may be clear plastic with a undersurface painted to permit various colors, finishes, and ornamental designs to be applied prior to molding, or may be screen printed. This allows the back pack to be made with a larger variety of different and durable ornamental appearances.

The rigid insert panel of the base member and outer surface of the outer shell are both formed with a curvature which is concave in the direction facing a wearer's back, for following the general shape of the back, both from the top edge to the bottom edge and between the opposite sides of the panel outer surface and shell inner surface. The opposite sides of the bag, when closed shut by the zipper, generally taper in width from the lower to the upper end of the bag, and are also curved to follow the overall ergonomic curvature of the bag itself.

A smaller, add-on bag may be provided for carrying small items such as water bottles, keys, cell phones or the like on the outside of the back pack. This has fastener straps for securing to rings or loops provided for that purpose on the back pack, so that the bag can be secured on the outer surface of the outer shell in a "piggy-back" fashion.

According to another aspect of the present invention, a back pack is provided which comprises a base member having an inner face for facing the back of a wearer and a peripheral rim, an outer shell of rigid material having an outer face and a peripheral rim secured to the base member to form an enclosure between the base member and outer shell, a releasable fastener mechanism releasably securing the peripheral rims of the base member and outer shell together around part of the periphery to allow access to the enclosure, the outer shell having an upper end, a lower end, and opposite sides, the upper end facing the upper end of a wearer's back when the back pack is worn, and the outer face of the outer shell having an outwardly projecting, aerodynamically shaped hump extending from the upper end towards the lower end and raised outwardly from the remainder of the outer face, the hump having a first portion extending outwardly from the outer face to a first position, and a second portion curving gradually inwardly to meet the outer face.

The aerodynamic hump is shaped so as to complement the shape of a motorcycle rider's helmet and the back of the motorcycle rider when worn by the motorcycle rider leaning forward over the motorcycle handles, forming a smooth, aerodynamic curve from the helmet down to the wearer's back. This will provide improved airflow and reduced resistance over the rider's form.

The back pack of this invention has a unique, ergonomically designed and aerodynamic shape, combining the advantages of a hard, durable outer shell with the comfort of a padded base or inner wall, shaped to conform to the wearer's back. The shape of the back pack is designed to conform to the wearer and it will be comfortable to wear while providing protection of the contents against weather and impacts. The attachment of a zipper fastener directly between the outer shell and base member allows easy access to the interior of the bag while providing a secure, continuous closure.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
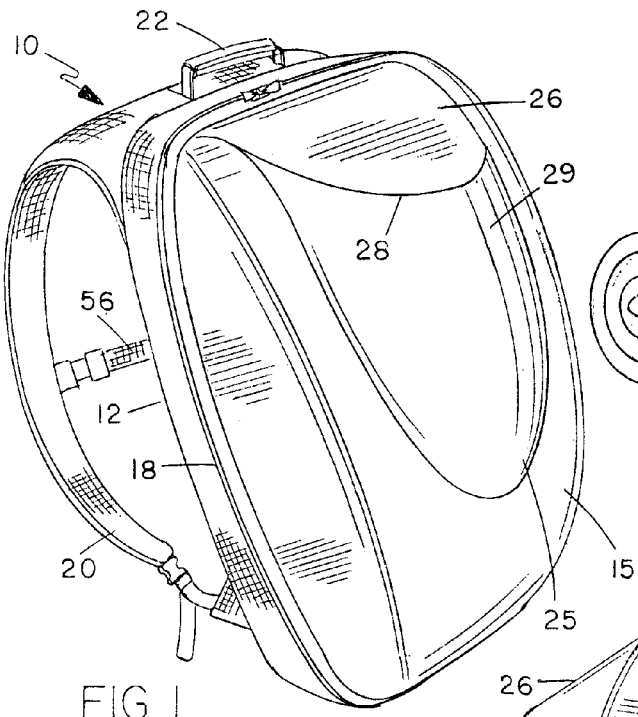
FIG. 1 is a front perspective view of a first embodiment of the backpack.
Figure 3:
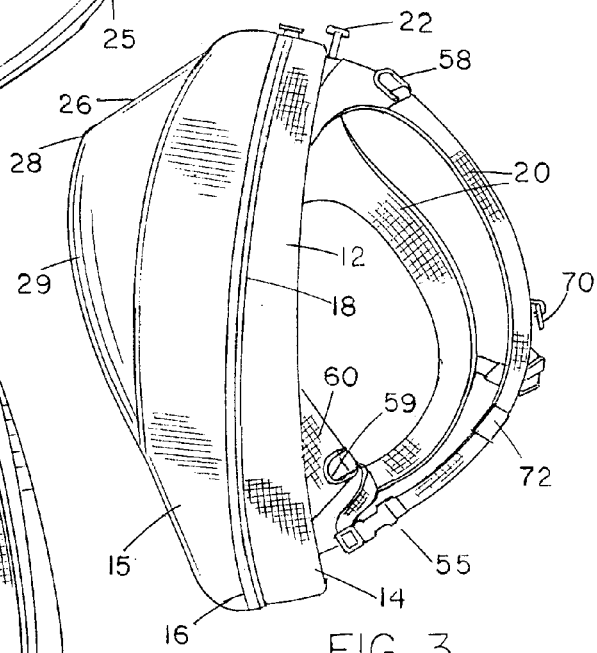
FIG. 3 is a side perspective view thereof.
Figure 2:
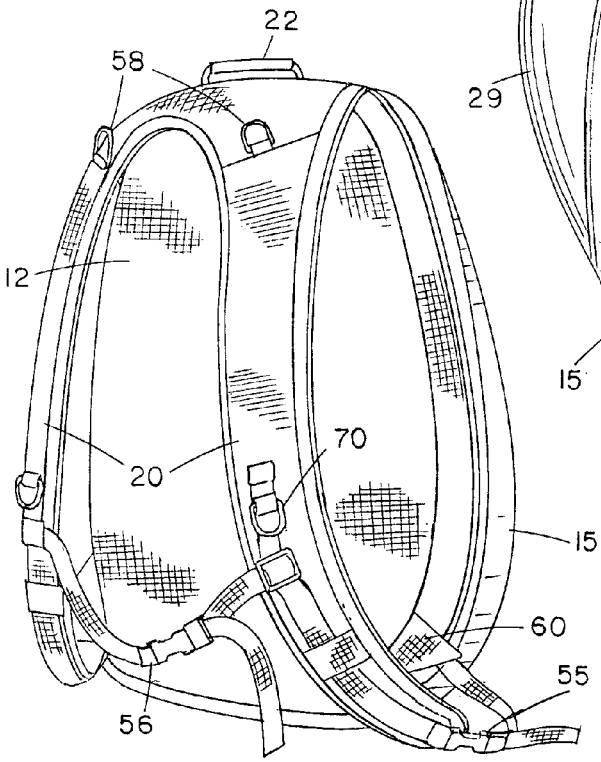
FIG. 2 is a rear perspective view thereof.

FIGS. 1 to 7, 12 and 13 of the drawings illustrate a back pack 10 according to a first embodiment of the invention. The back pack 10 basically comprises a base member 12 having a raised peripheral rim 14 around its periphery, and a shaped outer shell 15 of hard, rigid material having a peripheral rim 16 conforming to the rim of the base member 12. The base member and outer shell are permanently secured together at their lower ends via a connecting panel of fabric or other flexible material, and a zipper fastener 18 with two oversized zipper pulls 19 is secured between the base member and shell around the remainder of the periphery, as best illustrated in FIGS. 4 to 7, to provide a secure enclosure for carrying various items. Padded shoulder straps 20 are secured to the rear face of the base member, as indicated in FIGS. 2 and 3, and a carrying handle 22 is provided at the upper end of the base member.

The outer shell 15 is of a hard material such as ABS or polycarbonate plastic or other hardened, molded or reinforced plastic material, and is of sufficient thickness to be completely rigid. Where the material is ABS plastic, the thickness is suitably of the order of 2.5 mm. This material will still be relatively lightweight, yet durable and impact resistant. The outer shell 15 is molded into a predetermined aerodynamic and ergonomic shape which is both functional and attractive in appearance. In the first embodiment illustrated in FIGS. 1 to 7, 12 and 13, shell 15 is particularly designed to provide an aerodynamically shaped back pack for motor cycle or bicycle riders. Shell 15 has an outer surface which has a generally convex curvature overall, following the general curvature of a wearer's back 24 when riding a motorcycle (see FIG. 13), and has an outwardly projecting, aerodynamic hump 25 extending from its upper end towards its lower end. Hump 25 has a generally flat upper face 26 with a rounded outer edge 28, and a gently curving, aerodynamically shaped face 29 extending from edge 28 and tapering first outwardly, then inwardly and downwardly to merge with the remainder of the outer surface of the shell at a location spaced from the lower edge, as best illustrated in FIG. 1. The outer sides of hump 25 are also rounded and tapered down to the shell outer face, as best illustrated in FIG. 1.

Figure 13:
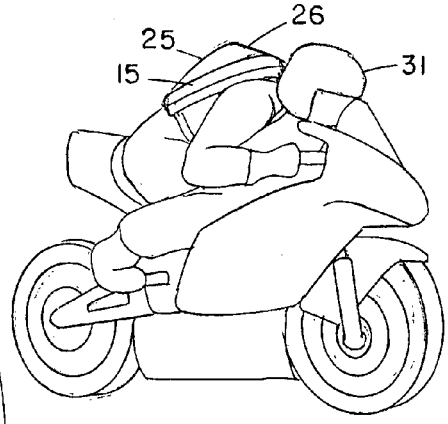
FIG. 13 is a schematic illustration of a motorcycle rider wearing the back pack of FIGS. 1 to 7.

The shape of hump 25 is such that, when the back pack is worn by a motorcycle rider leaning forward over the handle bars of a motorcycle, in the position illustrated in FIG. 13, the hump surface will follow the shape of the rider's helmet 31, smoothing the air flow as it comes off the helmet. The hump forms an aerodynamic curve from the helmet down to the wearer's back, providing improved air flow over the rider. This is similar to the aerodynamic hump provided in motor cycle racer's suits. In this case, the hump is instead provided on the outer face of a back pack, additionally providing storage space within the back pack for riders to carry various items, for example when traveling. This back pack will also have similar aerodynamic effects when worn by bicycle riders.

The hard outer shell may be provided in various different colors and with metallic or other finishes, and may have designs printed, painted or stamped on its outer or inner surface. It may be of a clear plastic painted on the inside prior to molding, to prevent damage or scuffing of the painted image, or may be screen printed or the like prior to molding. Alternatively, a fabric cover layer may be laminated onto the outer surface for a different look. A fabric layer 30 is suitably secured on the inner side of the hard shell, facing the interior of the back pack, and a foam padding layer (not illustrated) may be provided between the fabric layer 30 and shell 15 to protect and cushion the contents of the back pack. Pockets of various sizes and shapes may be sewn onto the inner face of the fabric layer 30 within the back pack for storage of smaller items.

Figure 12:
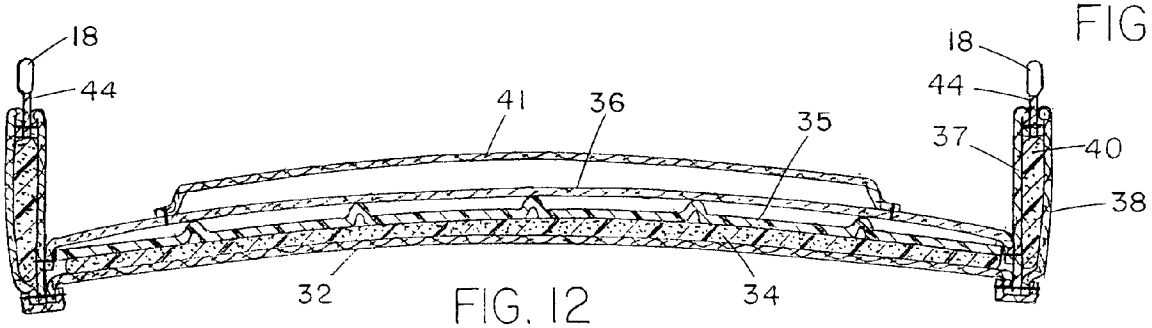
FIG. 12 is a cross-section on the lines 12—12 of FIG. 7.

The rear or inner wall of the base member 12 comprises an outer layer 32 of fabric, leather, or other flexible material, an inner layer 34 of foam padding material, an insert panel 35 of rigid material, and an inner layer 36 of flexible material such as fabric or the like, as illustrated in FIG. 12. The peripheral rim 14 comprises inner and outer fabric layers 37,38 with a central padding or foam layer 40 and is sewn to the periphery of the rear wall. The innermost layer of the rear wall of the base member has various pockets, such as pocket 41, and may also have one or more straps for storing items against movement in the back pack when carried, such as books, laptop computers, cameras, MP3 and CD players, and other items. Pocket 41 may be a relatively large pocket with a padded outer wall for storing a laptop computer or PC. A pocket (not visible in the drawings) adjacent the upper end of the innermost layer 36 is specifically shaped for portable MP3 or CD players, and a headphone access port 42 is provided in the upper end of rim 14 to allow headphones to be connected via a lead extending through port 42 to a player stored inside the back pack, so that the person carrying the back pack can listen to music or other recorded audio material.

Figure 6:
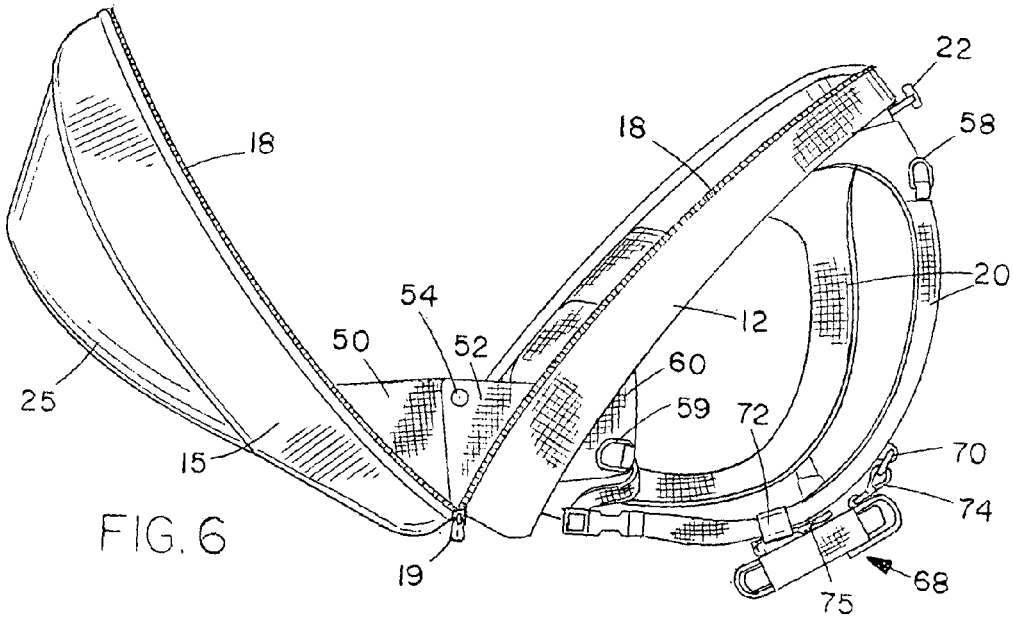
FIG. 6 is a side view of the backpack partially opened.

The insert panel 34 is of substantially rigid material which is curved to follow the contour of the back of a wearer of the back pack, with the same general curvature as the overall back pack as illustrated in FIG. 3, and has a concave face facing the outer layer 32 of the rear wall. Generally vertical ribs 43 are provided for added rigidity. The panel is capable of maintaining its shape and is resistant to bending in a vertical direction. The panel 34 may be of any suitable lightweight yet rigid plastic material, such as the same plastic material as the outer hard shell 15, or polyethylene foam board material. It may be formed by stamping from a flat sheet of the material, or may be injection molded. It is sufficiently thick to provide the desired rigidity, and may be of the order of 2 to 4 mm. in thickness, with a thickness of around 2.5 mm. in an exemplary embodiment. The rigid insert panel makes the base member self supporting when the back pack is opened, as can be seen in FIG. 6, and also protects the wearer from sharp edges of items stored in the back pack, making it more comfortable to carry.

Figure 4:
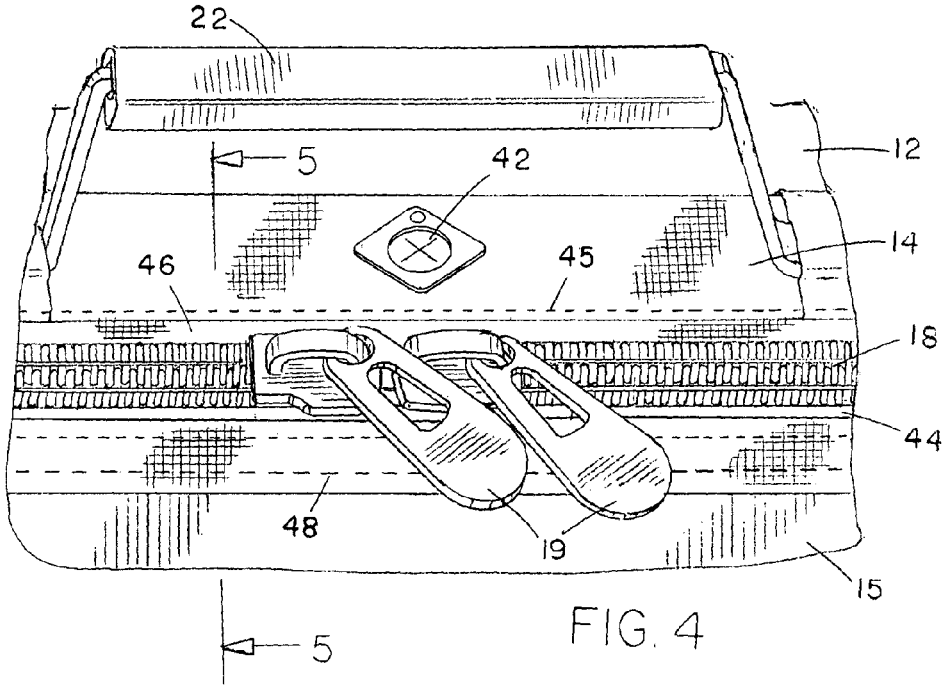
FIG. 4 is an enlargement of the upper cental portion of FIG. 1.
Figure 5:
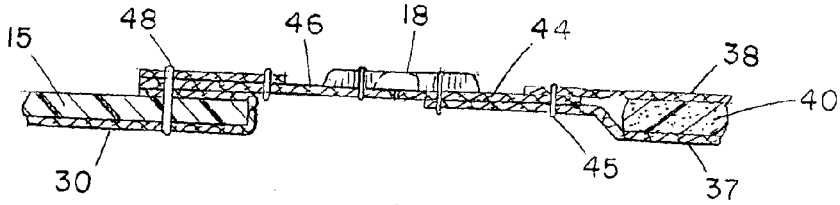
FIG. 5 is an enlarged sectional view taken on line 5—5 of FIG. 4.
Figure 7:
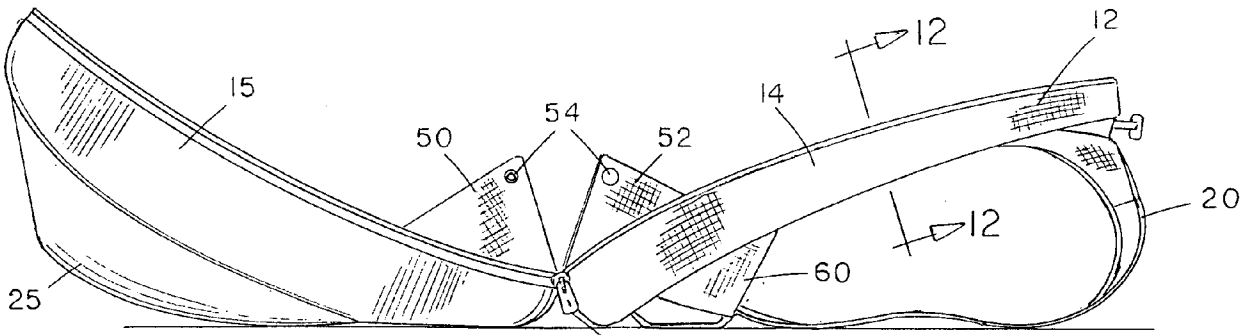
FIG. 7 is a side view of the backpack fully opened.

The zipper fastener 18 between the base member 12 and outer shell 15 is illustrated in more detail in FIGS. 4 and 5. Fastener 18 has a first flange 44 sewn directly to the fabric rim 14 of the base member via a first line of stitching 45, and a second flange 46 sewn directly to the rim 16 of the hard outer shell via a second line of stitching 48. Stitching 48 will be heavy duty thread, and will be applied by a heavy duty industrial sewing machine capable of stitching through hard plastic material. The zipper fastener extends around the sides and top of the back pack, while the base member and outer shell are secured together at their lower ends by a connecting piece of flexible material such as fabric, which is also sewn directly to the rims of the base member and shell. The flexible connecting piece acts as a hinge when the back pack is opened, as indicated in FIGS. 6 and 7.

The zipper pulls 19 are pulled together in order to secure the two halves of the zipper fastener together and hold the back pack in a closed and sealed condition, as illustrated in FIGS. 1 to 3. When the user wishes to open the bag in order to insert or retrieve items, they simply release the zipper fastener and rotate the hard shell and base member away from one another, as indicated in FIG. 6. Fabric flaps 50,52 secured to the inner sides of the base member and shell on each side of the bag have suitable releasable fasteners such as snap fasteners 54 to hold the bag in the partially open position of FIG. 6. If it is desired to fully open the bag, these fasteners are simply released, allowing the bag to be pulled into the fully open, generally flat condition of FIG. 7 for easy access to the entire contents of the bag.

Figure 11:
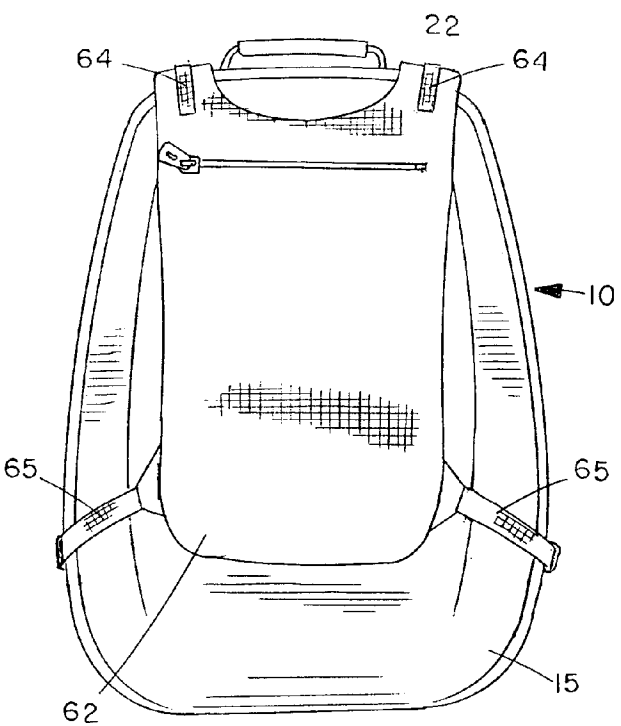
FIG. 11 shows the add-on pack attached to a basic backpack.
Figure 10:
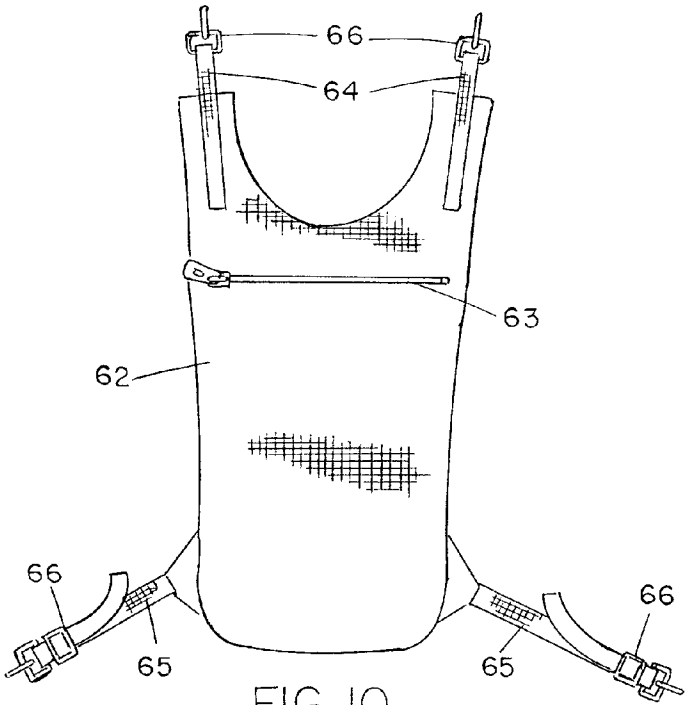
FIG. 10 is a front view of an add-on pack.

The shoulder straps 20 are of padded fabric or other flexible material. Straps 20 are secured to the top of the back face of the bag at one end and are each releasably secured to the lower end of the back face via an adjustable snap fastener 55 of a conventional nature, which also allows adjustment of the strap length. The snap fastener 55 has one half secured to the lower end of strap 20, and the other half secured to a fastener tab or flap 60 at the respective lower corner of the back pack. An adjustable, two part chest or waist strap 56 is provided between straps 20 for securing across the front of a wearer's chest or waist to hold the shoulder straps in position when the back pack is being carried. Loops or rings 58 are provided at the upper end of each strap 20, and additional loops 59 are provided on the fastener flaps 60. The purpose of loops 58,59 is to provide attachment points for an add-on or supplemental small bag 62, as illustrated in FIGS. 10 and 11.

The add-on or smaller bag 62 is of flexible material with a zipper 63 for access to the contents of the bag. The walls of the bag may be padded or lined with foam for added protection. The bag has two upper straps 64 extending from its upper corners, and two lower straps 65 extending from its lower corners, each strap having a snap on clip 66 at its free end. The bag is secured over the outer hard shell 15 of the bag in a "piggy-back" fashion, as indicated in FIG. 11, with the upper straps 64 extending over the top of the bag and the clips 66 snapped over the loops 58 at the upper ends of the shoulder straps 20. The lower straps 65 extend around the opposite sides of the bag and are clipped onto the rings or loops 59 on the fastener tabs 60 at the lower corners of the rear side of the back pack, which face generally outwardly. This provides a four-point attachment system for the add-on bag, holding it securely against the outside of the hard outer shell.

The small, supplemental bag 62 allows smaller and more frequently needed items to be stored in a readily accessible fashion, without needing to fully open the back pack. Such items may be water bottles, keys, books, wallets, and the like. This removable bag provides the option of expanding the carrying capacity of the back pack.

Another accessory which may be provided is a cell phone holder 68 which is designed to be secured to one of the shoulder straps 20 as illustrated in FIG. 6. As best illustrated in FIG. 2, each shoulder strap 20 has a second ring or loop 70 spaced below the upper loops 58 and adjacent the chest or waist strap 56. A strip 72 of fabric is secured across each strap 20 at a location spaced below the loop 70, by stitching at each end of strip 72, so that the strip also forms a loop. The cell phone holder 68 has a snap on clip 74 at its upper end for snapping onto loop or ring 70, and a hook 75 on its rear face for hooking over the fabric strip 72, as indicated in FIG. 6.

Figure 8:
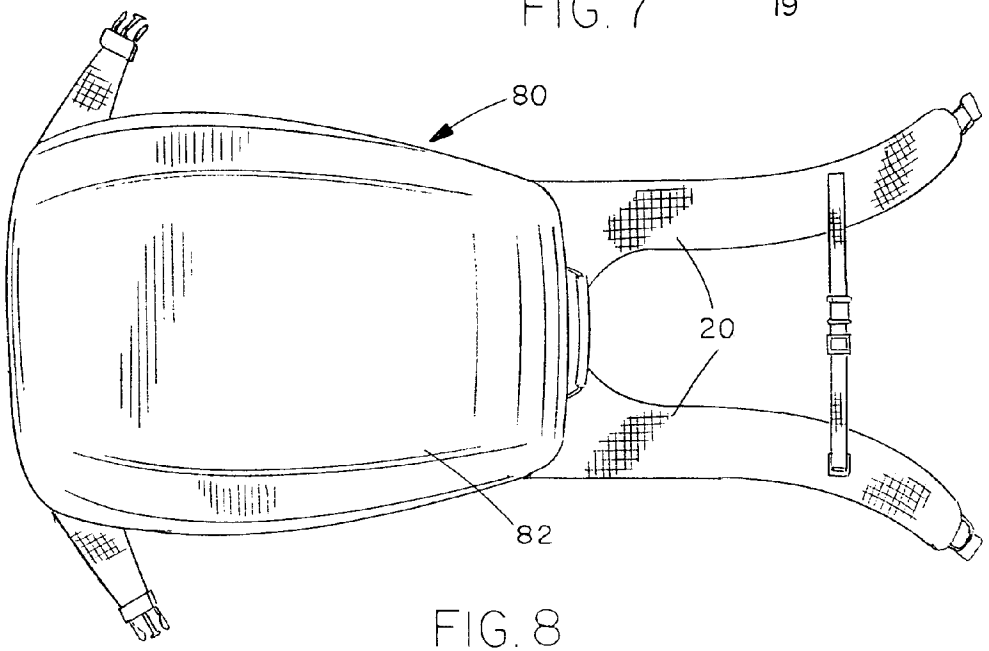
FIG. 8 is a front view of a backpack with an alternative shell configuration, the straps being extended.
Figure 9:
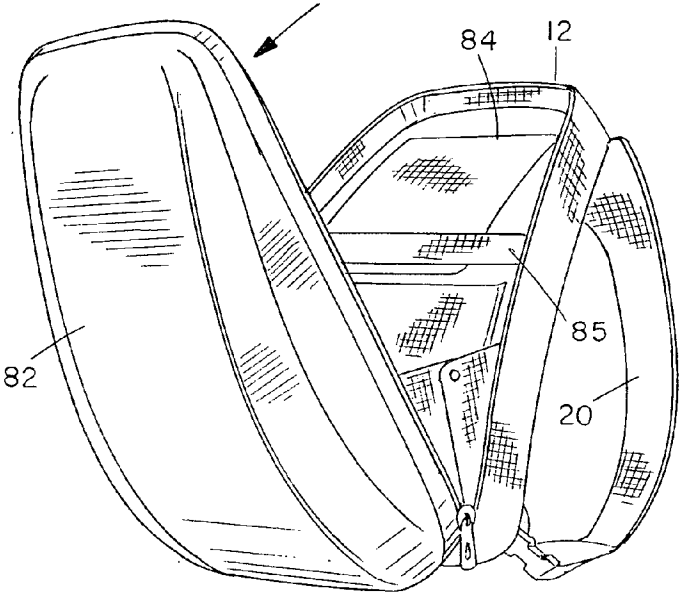
FIG. 9 is a perspective view of the backpack of FIG. 8 in partially opened position.

The back pack 10 of FIGS. 1 to 7 and 11 to 13 with an outer hard shell 15 having an aerodynamic hump 25 is particularly designed for motor bike riders. The sleek, aerodynamic shape provides improved airflow over the rider, while providing a large, secure interior carrying space which can be used for fragile items due to the hard, impact resistant outer shell. FIGS. 8 and 9 illustrate a back pack 80 with a modified outer shell 82 which excludes the aerodynamic hump and is designed for use when walking, jogging, or the like. The back pack 80 of FIGS. 8 and 9 is otherwise identical to that of the remaining drawings, and like reference numerals have been used for like parts as appropriate. In FIG. 9, the inside of the base member 12 is illustrated in more detail, with an upper pocket 84 designed for a CD or MP3 player, and a strap 85 for holding items such as laptop computers or the like.

The outer shell 82 is made of equivalent hard, durable, and impact-resistant material to the outer shell 15 of the first embodiment, and has a smooth, convex outer curvature from its upper to its lower end, as indicated in FIG. 9. The curvature overall is equivalent to that of shell 15 without the hump 25. In the closed condition of FIGS. 1 to 3, either back pack 10 or 80 has a generally concave inner face for conforming to the shape of the wearer's back, and a smooth, convex and aerodynamic outer face formed by the hard shell. The rims 14 and 16 of the base member and outer shell are cut on a radius to follow the general curvature of the rear face and front face of the back pack, as best illustrated in FIG. 3, providing a better fit and improved comfort to the user, as well as a more attractive and sleek overall appearance.

Although some exemplary embodiments of the invention have been described above by way of example only, it will be understood by those skilled in the field that modifications may be made to the disclosed embodiments without departing from the scope of the invention, which is defined by the appended claims.

I claim:

1. A back pack, comprising:

a base member for facing the back of a wearer having a rear wall and a raised peripheral rim, at least the peripheral rim being of flexible material;

an outer shell of rigid material for facing away from the back of the wearer, wherein the outer shell has an outer face and an integral peripheral rim bent towards the base member, and wherein the base member and the outer shell together define an enclosure for containing items to be carried; and a zipper fastener secured between the peripheral rims of the base member and outer shell and extending around at least a major portion of the rims for releasably securing the base member and shell in a closed position and allowing access to the enclosure when released.

2. The back pack as claimed in claim 1, wherein the peripheral rims have a lower end, opposite sides, and an upper end, the zipper fastener extends around the sides and upper end of the peripheral rims, and a flexible member secures the lower ends of the rims together, whereby the outer shell and base member may be rotated away from one another into a fully open condition when the zipper fastener is released.

3. The back pack as claimed in claim 2, including a releasable retaining assembly between the base member and outer shell for holding the back pack in a partially open position.

4. The back pack as claimed in claim 1, including a first line of stitching securing one side of the zipper fastener directly to the rigid rim of the outer shell, and a second line of stitching securing the other side of the zipper fastener directly to the flexible rim of the base member.

5. The back pack as claimed in claim 1, wherein the rear wall of the base member has inner and outer layers of flexible material and an insert panel of rigid material between the inner and outer layers, the rigid insert panel being self-supporting and capable of retaining its shape.

6. The back pack as claimed in claim 5, wherein the insert panel has a series of spaced ribs.

7. The back pack as claimed in claim 5, wherein the insert panel is curved to follow the curvature of a wearer's back and has a concave outer face facing the wearer's back when the back pack is carried.

8. The back pack as claimed in claim 7, including a layer of foam material between the insert panel and outer layer of the rear wall.

9. The back pack as claimed in claim 1, wherein the outer shell is of Acrylonitrile Butadiene Styrene(ABS) plastic material.

10. The back pack as claimed in claim 1, wherein shoulder straps are secured to the rear wall of the base member for supporting the back pack on the wearer's shoulders, the back pack having an upper end, lower end, and opposite sides, a carrying handle being secured to the upper end of the back pack.

11. The back pack as claimed in claim 1, wherein the outer shell has an upper end, a lower end, and opposite sides, the outer face of the shell having a convex curvature from the upper end to the lower end.

12. The back pack as claimed in claim 11, wherein the outer face of the shell has a raised, aerodynamically shaped hump adjacent the upper end of the shell and extending downwardly towards the lower end of the shell.

13. The back pack as claimed in claim 1, including an add-on bag of smaller dimensions than the back pack for releasably securing over the outer shell.

14. The back pack as claimed in claim 13, wherein the add-on bag is of flexible material and has two spaced upper straps and two spaced lower straps, each strap having a releasable fastener, the rear wall of the base member having attachment members for said releasable fasteners, whereby each strap can be extended from the outer shell to the rear wall with the add-on bag placed over the outer shell and the fasteners secured to the respective attachment members in a four point attachment system.

15. The back pack as claimed in claim 1, wherein the outer face of the outer shell is covered with a fabric material layer.

16. The back pack as claimed in claim 1, further comprising an aerodynamically shaped hump extending from the outer shell.

* * * * *